US006050000A

United States Patent [19]

Curzon

[11] Patent Number: 6,050,000

[45] Date of Patent: Apr. 18, 2000

[54] HAND DRYER

[75] Inventor: John Vigurs Curzon, Witney, United Kingdom

[73] Assignee: Airdri Limited, Oxon, United Kingdom

[21] Appl. No.: 09/187,723

[22] Filed: Nov. 5, 1998

[30] Foreign Application Priority Data

Nov. 6, 1997 [GB] United Kingdom ..... 97 23438

[51] Int. Cl.[7] ..... F26B 19/00

[52] U.S. Cl. ..... 34/572; 34/202; 34/227

[58] Field of Search ..... 34/572, 90, 96, 34/97, 98, 99, 100, 201, 202, 218, 221, 227; 165/200, 201, 205; 392/380, 381, 382, 384; D28/32, 54.1

[56] References Cited

U.S. PATENT DOCUMENTS

| | | | |
|---|---|---|---|
| 4,914,833 | 4/1990 | Pilolla et al. | 34/526 |
| 4,999,929 | 3/1991 | Dutton | 34/202 |
| 5,031,337 | 7/1991 | Pilolla et al. | 34/526 |
| 5,111,594 | 5/1992 | Allen | 34/202 X |
| 5,146,695 | 9/1992 | Yang | 34/202 X |
| 5,163,234 | 11/1992 | Tsukamoto et al. | 34/202 X |
| 5,459,944 | 10/1995 | Tatsutani et al. | 34/572 X |
| 5,873,179 | 2/1999 | Gregory et al. | 34/90 |
| 5,974,685 | 11/1999 | Hironaka | 34/202 |

*Primary Examiner*—Stephen Gravini
*Attorney, Agent, or Firm*—Davis and Bujold

[57] ABSTRACT

A hand dryer comprising: a housing containing a duct defining a pathway for air through the housing from an inlet to the housing to an outlet from the housing; the duct having a longitudinal axis extending a major length of the duct; the duct in the vicinity of the inlet defining a minor length of the duct with a secondary longitudinal axis the section of the duct along the secondary longitudinal axis having a cross section transverse the secondary axis in the form of a figure having a boundary with a maximum linear dimension no more than twice a minimum linear dimension; the duct in the vicinity of the outlet defining a slot lying substantially transverse the longitudinal axis; the slot having a width at least four times greater than its height; the duct in passing from the extended volume to the slot; changing in cross section from the section to the slot to provide a relatively smooth transition in shape for the pathway from the inlet to the outlet; and following a path lying around the longitudinal axis of the section; a heater for transferring heat into air in the pathway; a fan for accelerating a flow of air along the pathway from the inlet to the outlet for egress therefrom into a drying zone in the vicinity of the housing; a motor for driving the fan; and control means regulating operation of the dryer.

4 Claims, 3 Drawing Sheets

HAND DRYER

This invention relates to a drier. It relates particularly, but not exclusively, to a drier for the drying of hands, hands and face or hair which for brevity is hereinafter referred to as a hand drier. Such a drier is frequently provided in places like cloakrooms, changing rooms, offices, restaurants and public wash places.

A hand drier has to meet a number of functional requirements. The drying of recently washed hands needs to be completed in a reasonable time, say thirty seconds. Taking the blower as being capable of providing an airflow of about 150 cubic feet per minute then there will be a requirement for a substantial amount of electrical power, typically 2.5 kilowatts, for the blower and an air heater. Effectively this leads to a need for a mains power supply together with protection and timing devices to ensure safe and economic operation of the drier.

For control purposes it is known to make use of an infra-red transmitter/receiver arrangement making up part of an operational loop located in a working volume downstream of an outlet aperture of the hand drier. The transmitter periodically emits an infra red beam into the working volume. The operational loop is completed when an object is introduced into the working volume causing the beam to be reflected, to a greater or lesser extent, back to a corresponding receiver part of the arrangement. Thereupon a timed air heating and blowing cycle is initiated. Problems can arise with existing arrangements of this general type. There is a need to ensure that on the one hand the working volume is not so large (that is to say that the transmitter range is so long) that it extends far enough from the drier outlet to result in the loop being completed by an object entering the working volume for which no drying action is required. On the other hand there is a need to ensure that the working volume is not so small (that is to say the transmitter range is so short) that in order to close the loop and so initiate the cycle an object for drying has to be located so close to the outlet that it effectively blocks it.

According to the present invention there is provided a hand drier comprising:

- a housing containing a duct defining a pathway for air through the housing from an inlet to the housing to an outlet from the housing;
- the duct having a longitudinal axis extending a major length of the duct;
- the duct in the vicinity of the inlet defining a minor length of the duct with a secondary longitudinal axis the section of the duct along the secondary longitudinal axis having a cross section transverse the secondary axis in the form of a figure having a boundary with a maximum linear dimension no more than twice a minimum linear dimension;
- the duct in the vicinity of the outlet defining a slot lying substantially transverse the longitudinal axis; the slot having a width at least four times greater than its height;
- the duct in passing from the extended volume to the slot:
  - changing in cross section from the section to the slot to provide a relatively smooth transition in shape for the pathway from the inlet to the outlet; and
  - following a path lying around the longitudinal axis of the section;
- a heater for transferring heat into air in the pathway;
- a fan for accelerating a flow of air along the pathway from the inlet to the outlet for egress therefrom into a drying zone in the vicinity of the housing;

- a motor for driving the fan; and
- control means regulating operation of the dryer.

According to a first preferred version of the present invention the heater is located at or near the upstream end of the section.

According to a second preferred version of the present invention or of the first preferred version thereof the fan is located upstream of the heater.

According to a third preferred version of the present invention or any preceding preferred version thereof the control means includes an infra red sensing device adapted to detect the presence or absence of an object in the vicinity of the outlet and in the event that an object is detected in the vicinity a drying cycle is initiated by energising the motor and the heater to create a flow of heated air along the flow path.

An exemplary embodiment of the invention will now be described with reference to the accompanying drawing of a hand drier of which:

Figure 1:
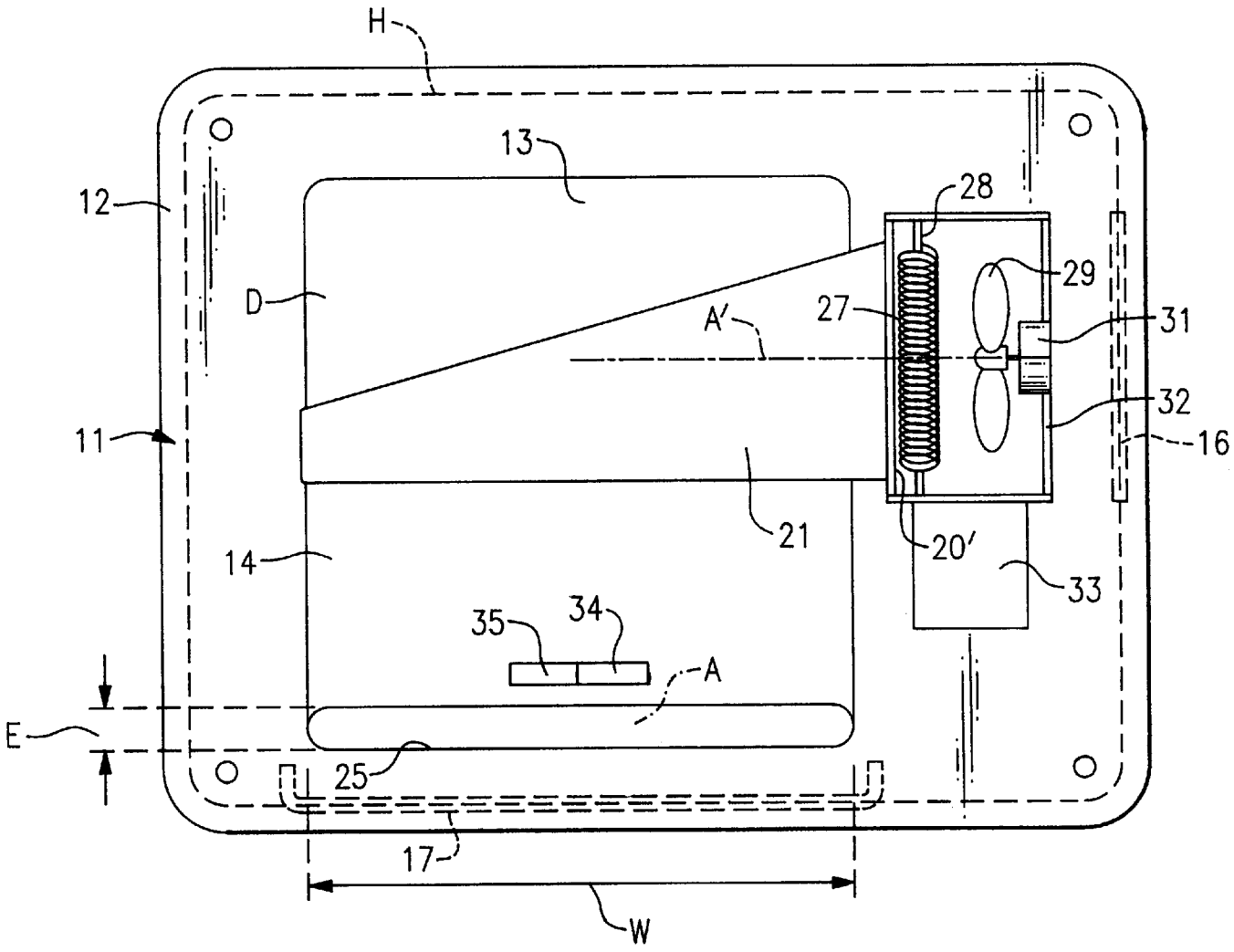
FIG. 1 is a front view.
Figure 2:
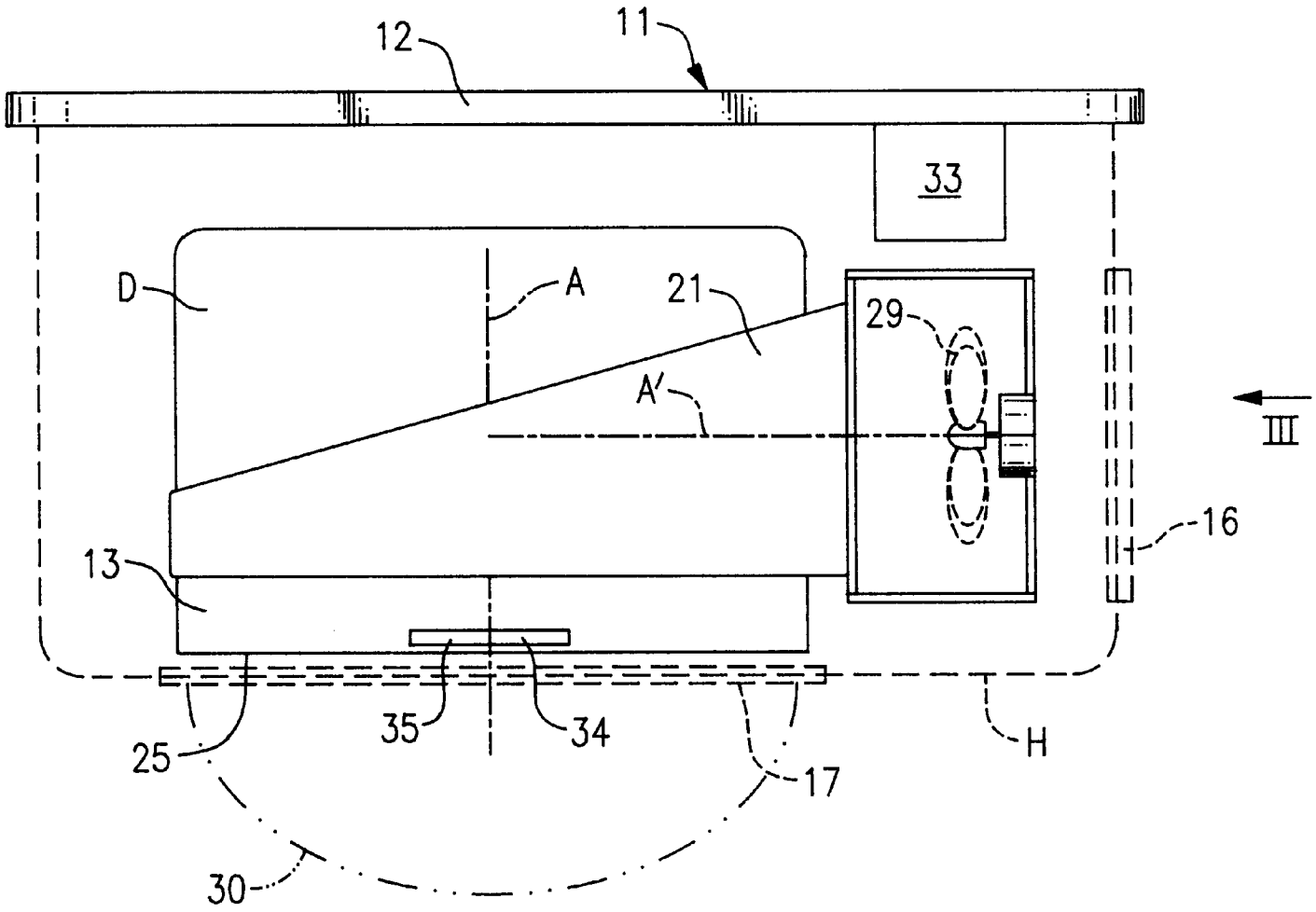
FIG. 2 is plan view from above.
Figure 3:
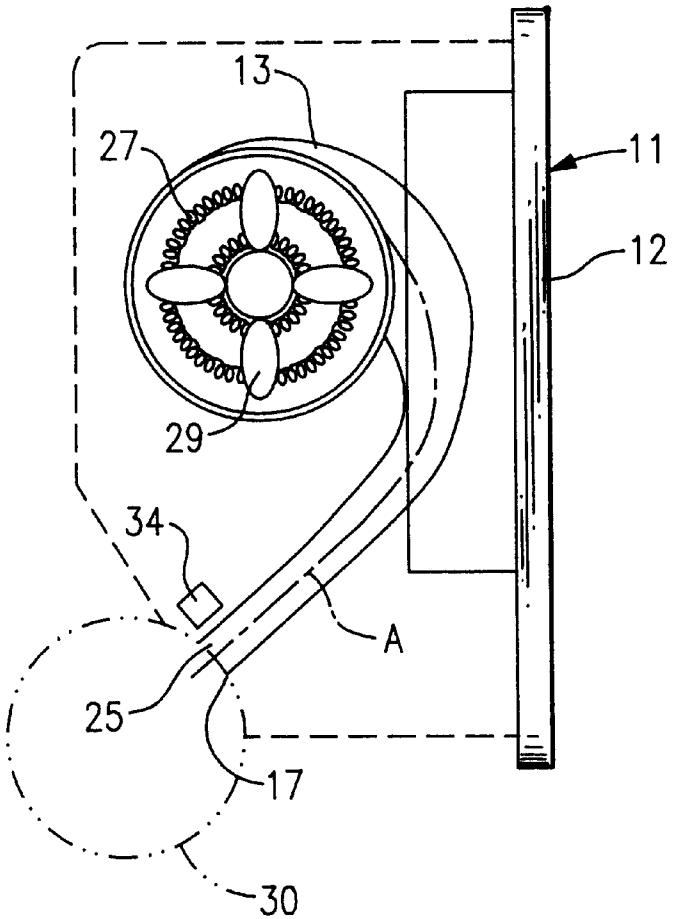
FIG. 3 is a side view in direction of arrow III in FIG. 2.

FIGS. 1 to 3 variously show a hand drier 11 mounted on a back plate 12 by means of which the drier 11 is secured to a wall. The hand drier 11 includes a cover H shown only in part and in chain dotted outline to clarify the subsequent description of hand drier 11 and its components. The back plate 12 and cover H together serve to define a housing for the drier 11. The housing incorporates a duct 13 with a central axis A providing an air flow path through the drier 11.

Figure 4:
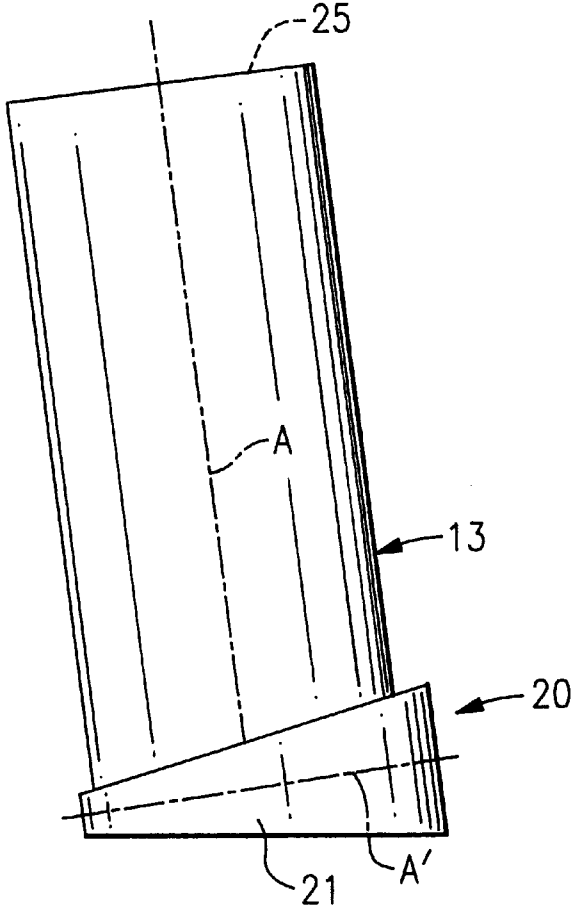
FIG. 4 is a developed view of a duct for a flow-path of air discussed in relation to FIGS. 1 to 3.

In FIGS. 1 to 3 most of central region D of the duct 13 is shown wrapped around itself to provide a compact configuration for an air flow path within the housing. The duct 13 is shown in developed form in FIG. 4. Duct 13 has a wall 14 of sheet metal. The duct 13 extends through the housing from an inlet 16 to an outlet 17 in the cover H.

Inlet end 20 of the duct 13 is juxtaposed with inlet 16. Section 21 at least in part in having a circular cross section is a direction transverse longitudinal axis A.

The duct 13 has an outlet in the form of a slot 25 lying substantially transverse the axis A. The slot 25 has a lateral width W at least four times greater than height F.

The duct 13 in passing from the inlet 21 to the slot 25 changes gradually in cross section from a circle to a slot form with a relatively smooth transition in shape for air flow along the pathway. This serves to reduce pumping loss and to minimise noise generation. By wrapping duct 13 so that its axis A is coiled around axis A' it is possible to enclose the resulting drier in a relatively small envelope.

A coiled heater element 27 is mounted over a former 28 at inlet 20. Upstream of the heater element 27 there is provided a blower 29 for driving a flow of air along the duct 13 from inlet 21 to the slot 25 and from thence into drying zone 30 (FIG. 2) adjacent outlet 17.

The blower 29 is driven by means of an electric motor 31 mounted upstream of the blower 29 by means of a spider 32. In operation the blower serves to draw relatively cool ambient air over the motor 31.

A control unit 33 regulates operation of the drier 11 which is mains powered.

In drier 11 in the vicinity of the slot 25 of the duct 13 there is provided an infra red emitter 34 and receiver 35 directed towards the centre of drying zone 30. With the drier 11 in a stand-by mode of operation the emitter 34 is caused by control unit 33 to periodically transmit a low power pulse of infra red emission. If an object is introduced into the zone 30 then the next infra red pulse will at least in part be reflected back off the object to receiver 34 which will consequently cause a signal to be passed to the control unit 33 which causes a drying cycle to be initiated involving the powering up of fan 29 and heater element 27 for a predetermined period.

Once the emitter 34 and receiver 35 no longer serve to detect the presence of an object in zone 30 then the control unit 33 operates to cause the drier 11 to revert to a quiescent standby state.

The control unit 33 includes safety means providing for safe operation of the drier in the event of malfunction or damage. Thus if on initiating a drying cycle in the event the fan does not run up to speed within a predetermined period then the heater is not energised and the cycle is aborted. Likewise in the event the inlet to the housing is blocked whether deliberately or inadvertently so as to limit if not actually prevent air flow into the housing then any consequent unusual temperature differential detected along a length of the duct results in a drying cycle being aborted.

What is claimed is:

1. A hand dryer comprising:

a housing containing a duct defining a pathway for air through the housing from an inlet to the housing to an outlet from the housing;

the duct having a longitudinal axis extending a major length of the duct;

the duct in the vicinity of the inlet defining a minor length of the duct with a secondary longitudinal axis, the section of the duct along the secondary longitudinal axis having a cross section transverse the secondary axis in the form of a figure having a boundary with a maximum linear dimension no more than twice a minimum linear dimension;

the duct in the vicinity of the outlet defining a slot lying substantially transverse the longitudinal axis; the slot having a width at least four times greater than its height;

the duct in passing from the extended volume to the slot:

changing in cross section from the section to the slot to provide a relatively smooth transition in shape for the pathway from the inlet to the outlet; and following a path lying around the longitudinal axis of the section;

a heater for transferring heat into air in the pathway;

a fan for accelerating a flow of air along the pathway from the inlet to the outlet for egress therefrom into a drying zone in the vicinity of the housing;

a motor for driving the fan; and control means regulating operation of the dryer.

2. A hand drier as claimed in claim 1 wherein the heater is located at or near the upstream end of the section.

3. A hand drier as claimed in claim 1 wherein the fan is located upstream of the heater.

4. A hand drier as claimed in claim 1 wherein the control means includes an infra red sensing device adapted to detect the presence or absence of an object in the vicinity of the outlet and in the event that an object is detected in the vicinity then a drying cycle is initiated by energising the motor and the heater to create a flow of heated air along the flow path.

* * * * *